US006109890A

United States Patent [19]

Horng

[11] Patent Number: 6,109,890

[45] Date of Patent: Aug. 29, 2000

[54] MINIATURE BLOWER ASSEMBLY FOR OUTPUTTING AIR IN A CERTAIN DIRECTION

[75] Inventor: Alex Horng, Kaohsiung, Taiwan

[73] Assignee: Sunonwealth Electric Machine Industry Co., Ltd., Taiwan

[21] Appl. No.: 09/109,729

[22] Filed: Jul. 2, 1998

[51] Int. Cl.[7] ..... F04B 17/03

[52] U.S. Cl. ..... 417/423.14; 417/423.15; 417/424.1; 165/122

[58] Field of Search ..... 417/423.1, 423.14, 417/423.15, 424.1; 165/121, 122

[56] References Cited

U.S. PATENT DOCUMENTS

| | | | |
|---|---|---|---|
| 4,773,829 | 9/1988 | Vettori | 417/366 |
| 5,100,298 | 3/1992 | Shibata et al. | 417/40 |
| 5,495,392 | 2/1996 | Shen | 361/697 |
| 5,519,574 | 5/1996 | Kodama et al. | 361/697 |
| 5,559,674 | 9/1996 | Katsui | 361/697 |
| 5,699,854 | 12/1997 | Hong | 165/121 |
| 5,734,553 | 3/1998 | Hong | 361/697 |
| 5,864,465 | 1/1999 | Liu | 361/697 |
| 5,868,197 | 2/1999 | Potier | 165/121 |
| 5,947,189 | 9/1999 | Takeuchi et al. | 165/51 |

*Primary Examiner*—Charles G. Freay
*Assistant Examiner*—Robert Z. Evora
*Attorney, Agent, or Firm*—Stevens, Davis, Miller & Mosher, L.L.P.

[57] ABSTRACT

A miniature blower assembly includes a base plate, a circuit board, a coil seat, a blower, and an upper lid. The base plate includes an air outlet and a spiral air passage communicated with the air outlet. The base plate further includes a recessed area, a bottom wall which defines the recessed area including a peg formed thereon. The circuit board is received in the recessed area of the base plate and includes a sensor element and a plurality of control elements mounted thereon. The coil seat is engaged on the peg on the base plate and includes an axle tube and a winding wound therearound. The blower includes a shaft rotatably received in the axle tube. The upper lid is releasably engaged with the base plate and includes an inlet opening communicated with the spiral air passage.

7 Claims, 4 Drawing Sheets

MINIATURE BLOWER ASSEMBLY FOR OUTPUTTING AIR IN A CERTAIN DIRECTION

BACKGROUND OF THE INVENTION

1. Field of the Invention

The present invention relates to a miniature blower assembly, and more particularly to a miniature blower assembly for outputting air in a certain direction with a minimized thickness.

2. Description of the Related Art

Taiwan Utility Model Publication No. 316733 issued on Sep. 3, 1997 discloses a miniature blower assembly for outputting air in a certain direction. This blower assembly includes a base plate with a spiral air passage and an outlet in the form of a notch. The base plate further includes a member for engaging with an axle tube on a coil seat. A shaft of the blower is rotatably mounted in the axle tube for driving air from an inlet to the outlet via the spiral air passage. The base plate further includes a number of engaging notches for releasably engaging with a corresponding number of snapping fasteners projecting downwardly from an upper lid. Nevertheless, a number of control elements (such as integrated circuits) are mounted to an underside of the coil seat and thus cause an increase in the thickness of the coil seat. As a result, the thickness of the blower assembly cannot be reduced as desired by the art. In addition, the integrated circuits of the blower assembly cannot be effectively cooled, which may reduce the life period of the elements. The present invention is intended to provide an improved design to solve these problems.

SUMMARY OF THE INVENTION

A primary object of the present invention is to provide an improved miniature blower assembly that may output air in a certain direction and has a minimized blower thickness by means of mounting the control elements (such as integral circuits) to an area distal to the blower.

A miniature blower assembly in accordance with the present invention comprises a base plate, a circuit board, a coil seat, a blower, and an upper lid. The base plate includes an air outlet and a spiral air passage communicated with the air outlet. The base plate further includes a recessed area, a bottom wall which defines the recessed area including a peg formed thereon. The circuit board is received in the recessed area of the base plate and includes a sensor element and a plurality of control elements mounted thereon. The coil seat is engaged on the peg on the base plate and includes an axle tube and a winding wound therearound. The blower includes a shaft rotatably received in the axle tube. The upper lid is releasably engaged with the base plate and includes an inlet opening communicated with the spiral air passage. By such an arrangement, the overall thickness of the blower assembly is minimized. The bottom wall which defines the recessed area of the base plate includes a receptacle for receiving the sensor element of the circuit board. In an embodiment of the invention, the base plate includes a side opening defined in a side thereof, and the circuit board includes a connector received in the side opening. The connector is to be electrically connected to a power source. In an alternative embodiment of the invention, the base plate includes a side opening defined in a side thereof. A second bottom wall that defines a portion of the side opening includes a retaining wall projecting upwardly. The upper lid includes a block provided to an underside thereof. A wire means has a first end electrically connected to the circuit board and a second end electrically connected to a power source. The block and the retaining wall define a zigzag passage through which the wire means extends to retain the wire means in position. The upper lid further includes at least one retainer formed on an upper side thereof for retaining the circuit board in the recessed area. The circuit board may include a hole which receives the peg on the base plate. The base plate includes a plurality of engaging notches defined in a periphery thereof, and the upper lid includes a plurality of snapping fasteners for releasably engaging with the engaging notches.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
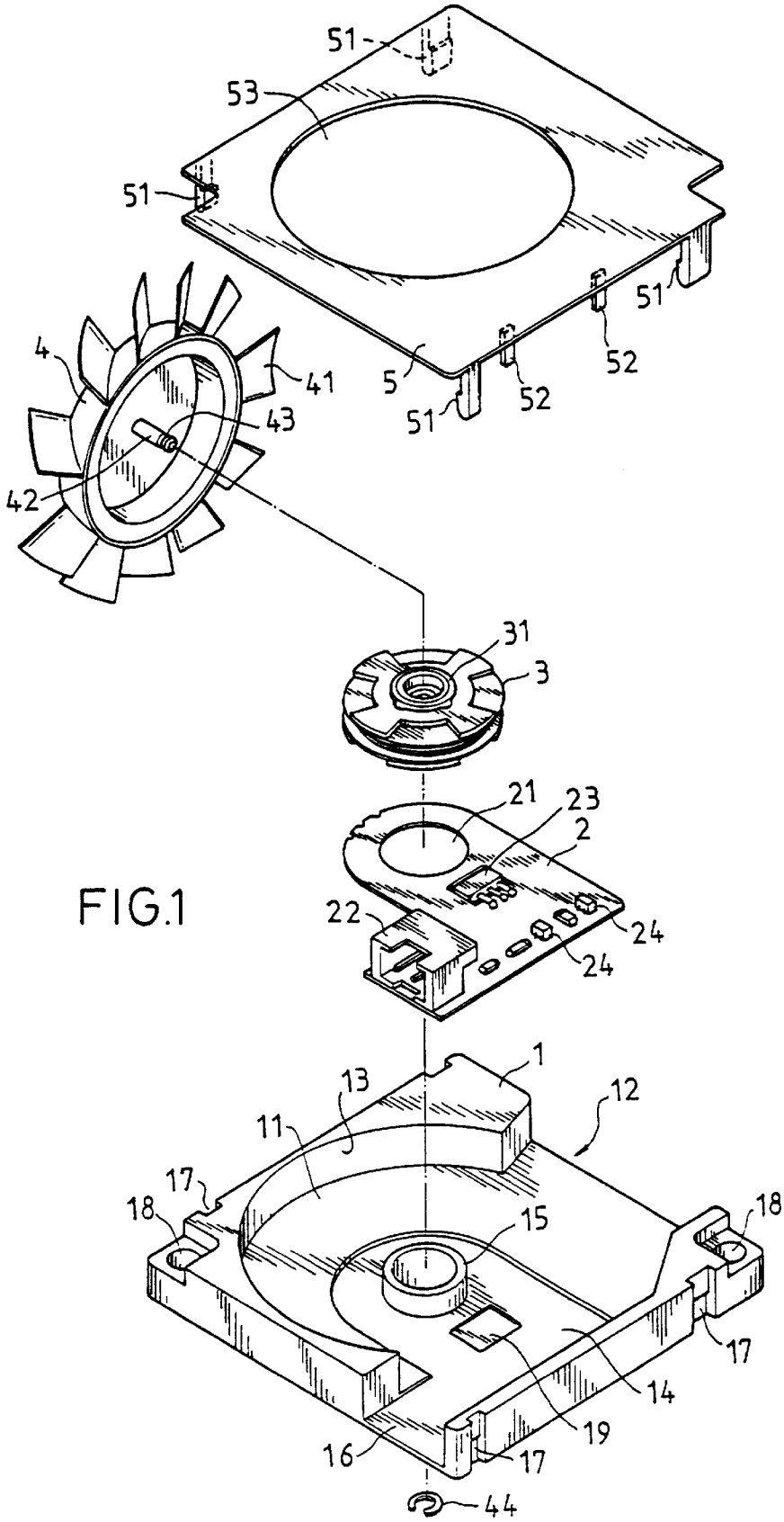
FIG. 1 is an exploded perspective view of a miniature blower assembly in accordance with the present invention.

Referring initially to FIG. 1, a miniature blower assembly in accordance with the present invention generally includes a base plate 1, a circuit board 2, a coil seat 3, a blower 4, and an upper lid 5. The base plate 1 includes an air outlet 12 and a spiral air passage 11 defined by an inner arcuate wall and communicated with the air outlet 12. A direction member (not shown) may be provided adjacent to the air outlet 12 to guide output direction of air. The base plate 1 further includes a recessed area 14 defined in a bottom thereof for fittingly receiving the circuit board 2. A bottom wall that defines the recessed area 14 includes a holed peg 15 for securely engaging with the coil seat 3. The base plate 1 further includes a side opening 16 defined in a side thereof which is preferably opposite to the air outlet 12. In addition, the base plate 1 includes a number of engaging notches 17 defined in an outer periphery thereof, which will be described later. The base plate 1 further includes a number of positioning holes 18 so as to be secured to a proper location.

Figure 2:
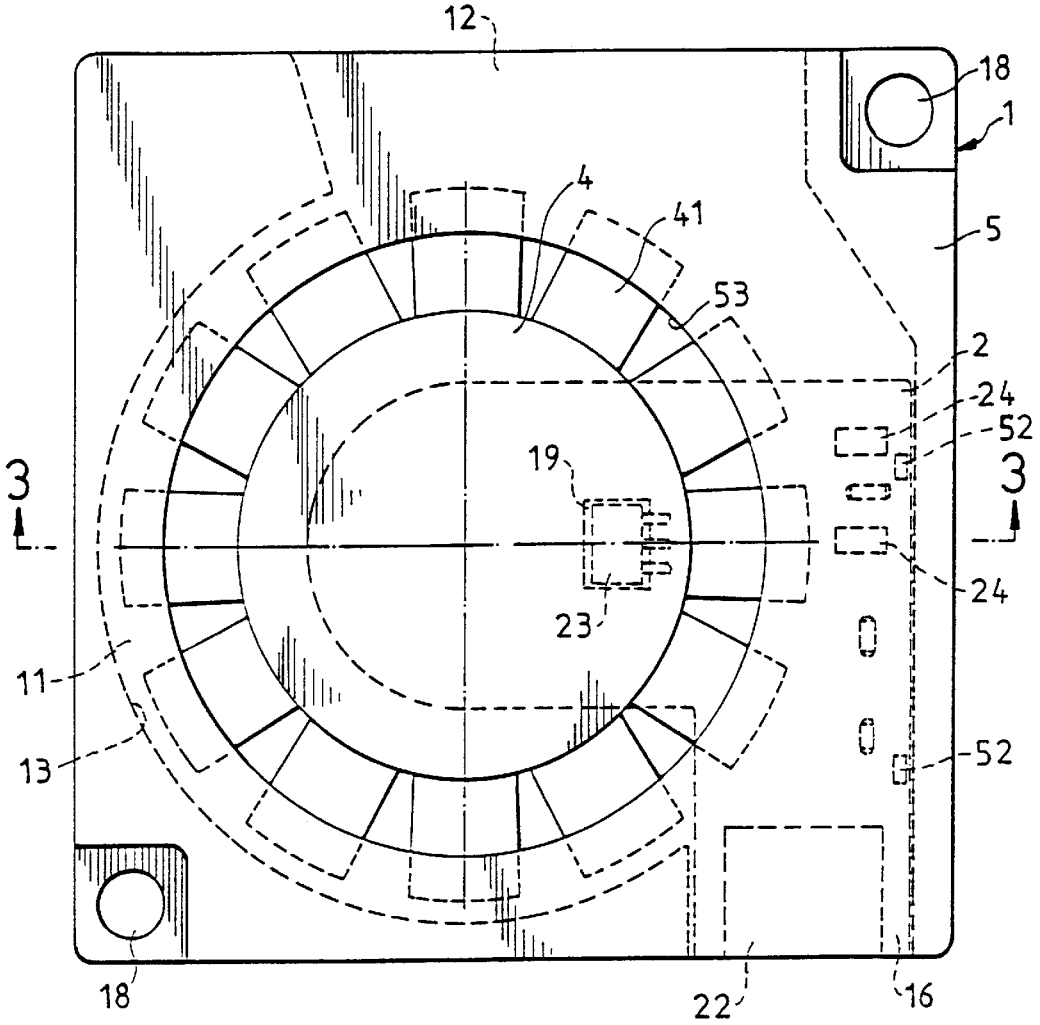
FIG. 2 is a top view of the miniature blower assembly in accordance with the present invention.

The circuit board 2 is mounted in the recessed area 14 and includes a hole 21 so as to be mounted around the peg 15 to provide a positioning effect. A number of control elements, e.g., integrated circuits 24 are mounted to the circuit board 2. The circuit board 2 further includes a connector 22 mounted thereon for connection with a power source (not shown). The connector 22 may be received in the side opening 16 (FIG. 2). The circuit board 2 further includes a sensor element 23 mounted thereon. The bottom wall that defines the recessed area 14 may further include a receptacle 19 defined therein for fittingly receiving the sensor element 23 to reduce the overall thickness of the blower assembly. The sensor element 23 is located below a pole of the coil seat for starting the blower 4. By such an arrangement, the integrated circuits 24 shall not interfere with rotation of the blower 4, and the overall thickness of the blower assembly is minimized. Further, the blower 4 can cool the integrated circuits 24 more efficiently.

The coil seat 3 includes a winding wound therearound and polar plates with poles of a desired number for controlling rotation of the blower 4. The coil seat 3 further includes an axle tube 31 that engages with the peg 15 on the base plate 1. The blower 4 includes a shaft 42 rotatably received in the axle tube 31 and includes a number of blades 41. The shaft 42 may include an annular groove 43 defined in a distal end thereof, and a C-clip 44 is mounted to the annular groove 43 to prevent disengagement of the shaft 42.

The upper lid 5 includes a number of downwardly extending snapping fasteners 51 for releasably engaging with the engaging notches 17 in the base plate 1. The upper lid 5 further includes a number of retainers 52 formed on an underside thereof for retaining the circuit board 2 in the recessed area 14 by means of directly abutting on an upper side of the circuit board 2. The upper lid 5 further includes an opening 53 that acts as an inlet for air and communicates with the spiral air passage 11.

Figure 3:
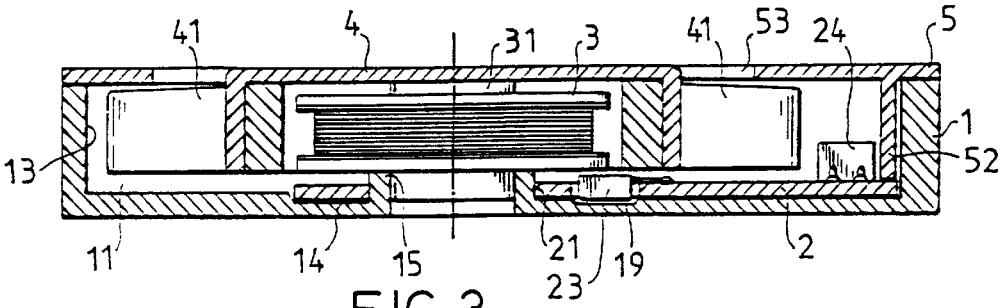
FIG. 3 is a sectional view taken along line 3—3 in FIG. 2.
Figure 4:
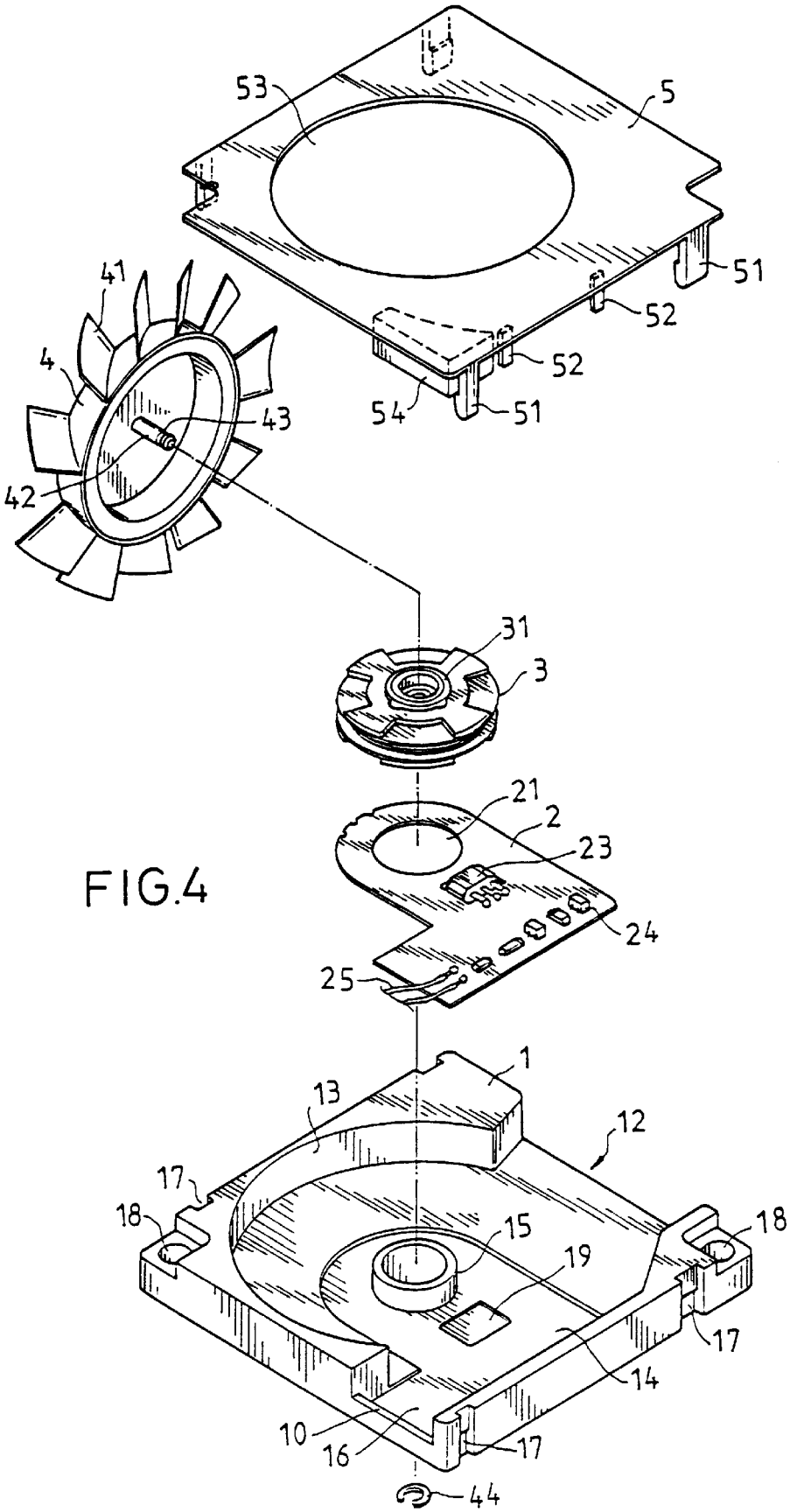
FIG. 4 is an exploded perspective view of a modified embodiment of the miniature blower assembly in accordance with the present invention.

Referring to FIGS. 2 and 3, the integrated circuits 24 shall not interfere with operation of the blower 4, instead, the former can be cooled by the latter. In addition, the overall thickness of the blower assembly is minimized.

Figure 5:
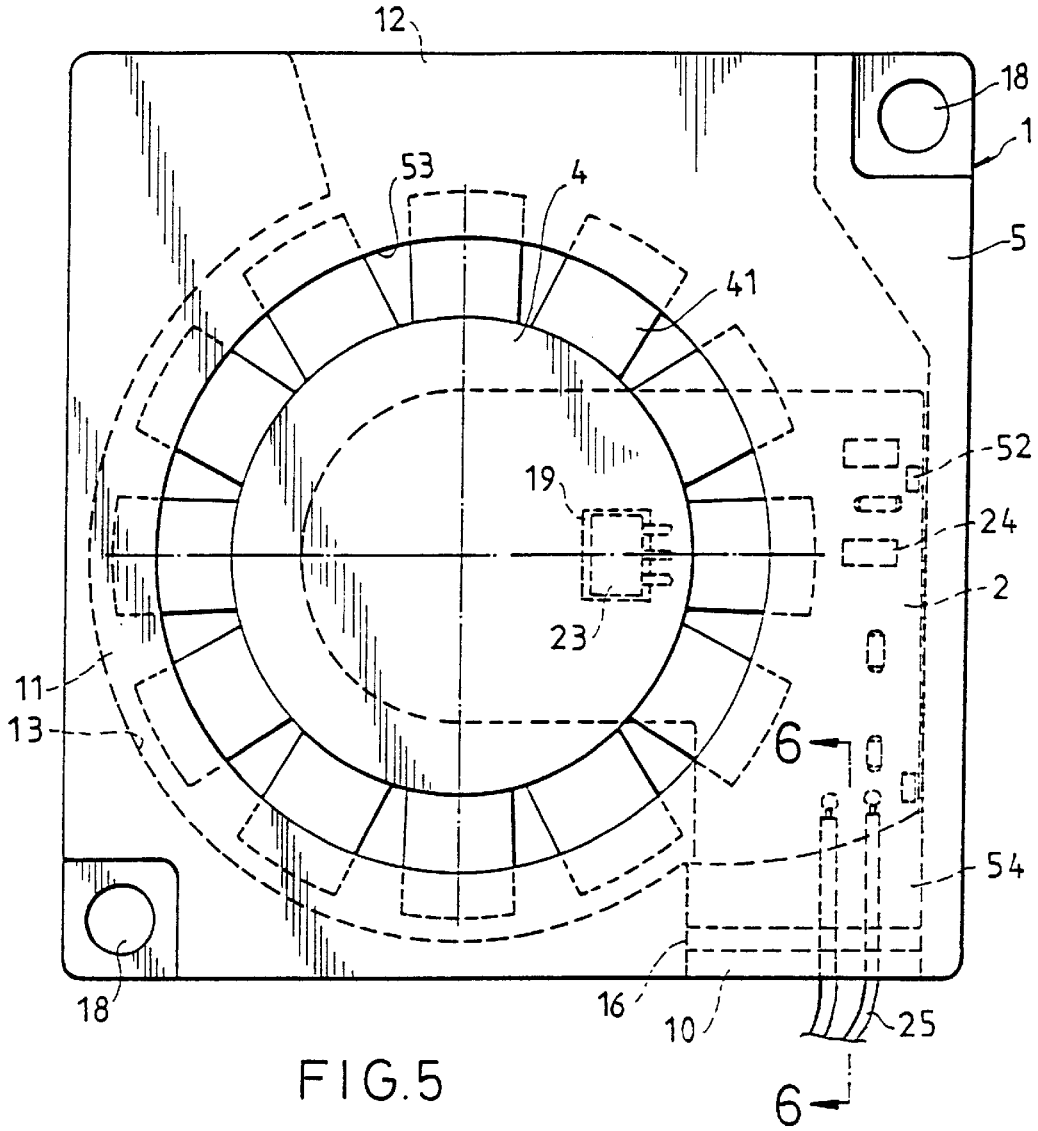
FIG. 5 is a top view of the blower assembly in FIG. 4.
Figure 6:
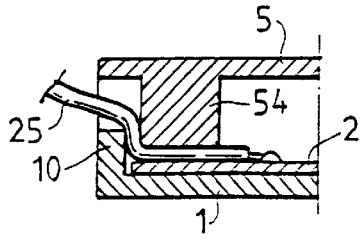
FIG. 6 is a sectional view taken along line 6—6 in FIG. 5.

FIG. 6 illustrates a modified embodiment of the blower assembly, in which the connector 22 in FIG. 1 is replaced by two wires 25 electrically connected to a power source (not shown). Further, the upper lid 5 includes a block 54, and a retaining wall 10 projects upwardly from a bottom wall that defines a portion of the side opening 16. As shown in FIGS. 5 and 6, after assembly, the wires 25 zigzag between the retaining wall 10 and the block 54 and are retained by the retaining wall 10 and the block 54. Thus, disengagement of the wires 25 from the circuit board 2 is prevented from.

Although the invention has been explained in relation to its preferred embodiment, it is to be understood that many other possible modifications and variations can be made without departing from the spirit and scope of the invention as hereinafter claimed.

What is claimed is:

1. A miniature blower assembly, comprising:

a base plate including an air outlet and a spiral air passage in communication with the air outlet, the base plate further including a recessed area, a bottom wall which defines the recessed area, and a peg formed on the base plate, a circuit board disposed in the recessed area of the base plate and including a sensor element and a plurality of control elements mounted thereon, a coil seat engaged on the peg on the base plate and including an axle tube and a winding wound around said axle tube, a blower including a shaft rotatably disposed in the axle tube, and an upper lid releasably engaged with the base plate and including an inlet opening in communication with the spiral air passage, wherein the sensor element is disposed between the base plate and the coil seat, whereby an overall thickness of the blower assembly is reduced; and the control elements are disposed in the spiral air passage to increase a heat dissipation effect of the control elements during operation.

2. The miniature blower assembly as claimed in claim 1, wherein the bottom wall which defines the recessed area of the base plate includes a receptacle for receiving the sensor element of the circuit board.

3. The miniature blower assembly according to claim 1, wherein the base plate includes a side opening defined in a side thereof, and the circuit board includes a connector received in the side opening, the connector being adapted to be electrically connected to a power source.

4. The miniature blower assembly according to claim 1, wherein the base plate includes a side opening defined in a side thereof, a second bottom wall that defines a portion of the side opening includes a retaining wall projecting upwardly, and wherein the upper lid includes a block provided to an underside thereof, and further comprises a wire means having a first end electrically connected to the circuit board and a second end adapted to be electrically connected to a power source, the block and the retaining wall define a zigzag passage through which the wire means extends to retain the wire means in position.

5. The miniature blower assembly as claimed in claim 1, wherein the upper lid further includes at least one retainer formed on an upper side thereof for retaining the circuit board in the recessed area.

6. The miniature blower assembly as claimed in claim 1, wherein the circuit board includes a hole which receives the peg on the base plate.

7. The miniature blower assembly as claimed in claim 1, wherein the base plate includes a plurality of engaging notches defined in a periphery thereof, and the upper lid includes a plurality of snapping fasteners for releasably engaging with the engaging notches.

* * * * *